US006605367B2

(12) United States Patent
Bassi et al.

(10) Patent No.: US 6,605,367 B2
(45) Date of Patent: Aug. 12, 2003

(54) PROTEIN/STARCH PAPER COATING COMPOSITIONS AND METHOD OF USE THEREOF

(75) Inventors: Sukh Bassi, Atchison, KS (US); Michael D. Cain, Lawrence, KS (US); Alan M. Hill, Tecumseh, KS (US); Clodualdo C. Maningat, Platte City, MO (US); Li Nie, Kansas City, MO (US)

(73) Assignees: Midwest Grain Products, Atchison, KS (US); Lawrence Paper Company, Lawrence, KS (US)

( * ) Notice: Subject to any disclaimer, the term of this patent is extended or adjusted under 35 U.S.C. 154(b) by 0 days.

(21) Appl. No.: 10/324,340

(22) Filed: Dec. 18, 2002

(65) Prior Publication Data

US 2003/0091852 A1 May 15, 2003

Related U.S. Application Data

(62) Division of application No. 09/754,469, filed on Jan. 3, 2001, now Pat. No. 6,517,625.

(51) Int. Cl.[7] ..... B32B 29/00

(52) U.S. Cl. ..... 428/537.5; 428/535; 428/536; 176/145.1; 176/145.4; 176/154.1; 176/157.2; 176/157.5; 176/157.7; 176/157.71; 176/157.9; 264/174

(58) Field of Search ..... 428/537.5, 535, 428/536; 176/145.1, 145.4, 154.1, 157.2, 157.5, 157.7, 157.71, 157.9; 264/174

(56) References Cited

U.S. PATENT DOCUMENTS

| | | | | |
|---|---|---|---|---|
| 6,022,450 A | * | 2/2000 | Van Kessel et al. | 162/174 |
| 6,174,559 B1 | * | 1/2001 | Shulman et al. | 426/656 |
| 6,197,353 B1 | * | 3/2001 | Shulman et al. | 426/52 |
| 6,517,625 B2 | * | 2/2003 | Bassi et al. | 106/145.1 |

* cited by examiner

*Primary Examiner*—Leszek Kiliman
(74) *Attorney, Agent, or Firm*—Hovey Williams LLP

(57) ABSTRACT

Improved compositions for coating paper stock, methods of forming such compositions, and methods of coating paper stock with those compositions are provided. The compositions comprise an aqueous dispersion including therein from about 20–45% by weight filler (e.g., a starch such as wheat starch) and from about 6–18% by weight wheat gluten. Preferably, the gluten is initially modified with a reducing agent so that the average molecular weight of the gluten is less than about 1,000 kDa. The compositions have a viscosity of up to about 2000 cP and a solids content of from about 25–57% by weight, thus making them suitable for high speed coating of paper stock. The finished, coated stock may be conventionally printed to achieve high gloss end products. The compositions are preferably water soluble, thereby greatly facilitating repulping of the coated stock.

8 Claims, 1 Drawing Sheet

PROTEIN/STARCH PAPER COATING COMPOSITIONS AND METHOD OF USE THEREOF

RELATED APPLICATION

This is a divisional application of Ser. No. 09/754,469 filed Jan. 3, 2001 now U.S. Pat. No. 6,517,625.

BACKGROUND OF THE INVENTION

1. Field of the Invention

The present invention is concerned with aqueous gluten-containing compositions useful for coating of paper stock, allowing the coated stock to be printed to obtain high quality, high gloss end products. More particularly, the invention is concerned with such compositions as well as methods of preparation and use thereof, where preferred compositions include reduced wheat gluten and wheat starch dispersions having relatively low viscosities up to about 2000 cP; these compositions are water soluble, so that the compositions and printing thereon may be easily removed from the paper stock by soaking in water, thereby facilitating repulping of the stock.

2. Description of the Prior Art

The paper and board industries are constantly searching for better ways to make coated paper and board with improved quality at reduced cost. Thus, coatings are commonly applied to paper stock in an attempt to make the surfaces of the paper stock conducive to printing using high speed web fed printing equipment by improving the smoothness, gloss, ink printing sharpness, drum adhesion and pick resistance of the stock. Known paper coating formulations include latex or other synthetic resin materials. The generally lower viscosity and water binding capabilities of these coatings allows applications of high solids coating layers onto paper stock. While these formulations do improve the surface properties of the paper stock, but they are very expensive and difficult to use. Moreover, latex/synthetic resin coatings are hard to remove, making de-inking and de-waxing of the stock very difficult; this in turn prevents effective repulping of the stock at a reasonable cost.

Gelatinized, hydrolyzed, and other modified starches have also been used in prior art paper coating compositions. However, the viscosities of these starches are so high that the solids content of the formulations must be limited. This results in compositions which do not adequately coat the paper. Furthermore, the unpredictable behavior of starches such as corn starch, wheat starch, and potato starch typically leads to inconsistent coating properties, particularly at high coating speeds.

Producers of consumer packaging products or other paper stock items requiring high quality, high gloss printing have almost without exception been forced to use relatively expensive grades of paper stock. Kraft stock is readily available and is much less expensive than other types of paper. However, it has heretofore been virtually impossible to use Kraft where high quality printing is needed, owing to the tendency of printing inks to absorb into and smear on Kraft.

There is accordingly a real and heretofore unresolved need for improved compositions which can be used to form smooth, high quality coatings on paper products On the one hand a successful coating composition must permit sharp printing of ink images at high printing speeds using conventional printing equipment. On the other hand, such a coating must be relatively low cost and not present undue application problems. Finally, given the increasing concern about recycling of paper products, an improved coating must not interfere with, and preferably should enhance, the ability to repulp the coated paper products after use thereof.

SUMMARY OF THE INVENTION

The present invention overcomes the problems outlined above, and provides coating compositions which can be used to coat paper stock of virtually any kind (and particularly relatively inexpensive Kraft stock), so that the coated stock can be printed using conventional equipment to obtain a final printed product of high quality with heretofore unobtainable gloss values. Moreover, the preferred compositions are water soluble to facilitate repulping of the coated and printed stock.

In more detail, the coating compositions of the invention are in the form of aqueous dispersions including therein respective quantities of filler and wheat gluten. The filler is normally present in the dispersion at a level of from about 20–45% by weight, and more preferably from about 25–35% by weight, based upon the total weight of the dispersion taken as 100% by weight. The filler can comprise a mineral filler, a starch, or mixtures thereof. Preferred mineral fillers include clay (#1 and #2), calcium carbonate (ground or precipitated), talc, and mixtures thereof, while preferred starch fillers include wheat starch, corn starch, potato starch, rice starch, tapioca starch, modified versions of these starches (e.g., hydroxypropylated, acetylated, crosslinked, oxidized, cationized, acid-thinned starches), and mixtures thereof.

The wheat gluten should be present in the dispersion at a level of from about 6–18% by weight, and more preferably from about 6–12% by weight, based upon the total weight of the dispersion taken as 100% by weight. The gluten may be derived from commercially available wheat glutens of varying grades.

As used herein, "gluten" or "wheat gluten" refers to native and/or modified wheat glutens of various types. For example, wheat gluten may be modified by reducing agent (s) as hereafter described. However, other wheat gluten modifications, either in addition to or in lieu of reducing agent treatment can be used. Thus, wheat gluten may be oxidized, acylated, alkylated, deaminated or hydrolyzed (with a degree of protein hydrolysis usually less than 1%) or subjected to combined treatments.

As indicated, the preferred wheat gluten is initially modified with a reducing agent so as to cleave at least some of the disulfide bonds therein (preferably at least about 5%, and more preferably from about 10–100% of the disulfide bonds) and reduce the average molecular weight of the gluten. Thus, the gluten utilized preferably has a weight average molecular weight of less than about 1,000 kDa, more preferably less than about 500 kDa, and most preferably from about 20–60 kDa.

The gluten reducing agent is preferably added to the dispersion at a level of from about 0.05–2.0% by weight, and more preferably from about 0.1–1.0% by weight, based upon the total weight of the gluten taken as 100% by weight. Preferred reducing agents include alkali metal sulfites, alkali metal bisulfites, alkali metal metabisulfites, sulfur dioxide, mercaptan, and cysteine, with sodium metabisulfite being the most preferred reducing agent.

The compositions should have a Brookfield viscosity (determined on an RVT model equipped with a #2 spindle; 100 rpm; 73–74° F.) of less than about 2000 cP, preferably less than about 500 cP, and more preferably from about 60–150 cP. Furthermore, the solids content of the dispersion is preferably from about 25–57% by weight, and more preferably from about 30–50% by weight, based upon the total weight of the dispersion taken as 100% by weight. Finally, the finished compositions should have a pH of from about 9–12, and more preferably from about 9.5–11.

Preferably, the compositions have a weight ratio of filler:wheat gluten of from about 3:1 to about 5:1, and more preferably from about 3:1 to about 4:1. Normally, the preferred dispersions made up of wheat gluten and wheat starch are formulated using initially separate starch and gluten, i.e., they are not both derived from a single wheat flour or the like. In another embodiment, the preferred compositions consist essentially of aqueous dispersions including therein starch (and especially wheat starch), wheat gluten, a reducing agent, and a base (e.g., NaOH).

The compositions may be formed by preparing an aqueous dispersion of water and gluten, and may also include from about 0.1–0.5% by weight of a defoamer (such as a silicone defoamer), based upon the total weight of all ingredients utilized taken as 100% by weight.

Thereupon, a base such as NaOH is mixed with the dispersion in sufficient amounts to yield a dispersion pH of from about 10–12, and more preferably from about 11.5–11.7. The base is typically mixed with the dispersion at a level of from about 1–3% by weight, and preferably from about 1.5–2.5% by weight, based upon the total weight of the gluten utilized taken as 100% by weight. After base addition, the reducing agent is mixed with the dispersion so as to cleave disulfide bonds in the gluten.

Next, a starch such as Midsol 50 wheat starch (available from Midwest Grain Products, Atchison, Kans.) is added to the gluten dispersion in the ratio of 3:1 to about 5:1 as a filler. Final pH of dispersion at this stage is in a range of 9.0–12.0, but preferable from 10.0 to 10.8.

In alternate forms, a dry mixture of wheat gluten, starch and a reducing agent (e.g., sodium metabisulfite) can be provided. As needed, this dry mixture may be processed by the addition of water in a vacuum dissolver so as to simultaneously reduce the gluten and provide the necessary mixing to create the use dispersion. The latter may be used directly by application to paper stock, or can be stored for future use. In such an embodiment, the starch:gluten ratio should be from about 3:1 to 5:1. The gluten is normally present at a level of from about 16–25% by weight of the dry composition, the starch is present at a level of from about 75–85% by weight of the dry composition, and the reducing agent is present at a level of from about 0.05–1% by weight of the wheat gluten. In the mixing procedure, an appropriate amount of the dry composition is added to water to achieve the above-described amounts of ingredients in a flowable coating composition.

The compositions hereof can be applied to paper stock (as used herein, paper stock is intended to include all forms, types and weights of paper such as Kraft stock). Conventional coating equipment can be employed for this purpose. Normally, in order to achieve the best quality coated stock, the compositions are applied as separate coatings or "bumps", with intermediate partial or complete drying and curing of the compositions. The final coated stock can be printed using normal web-fed printing equipment and conventional inks. A particular feature of the coated stock of the invention is that the final printing can achieve very high gloss values on the order of from about 50–65 units. Furthermore, the coated stock will give a passing result when subjected to Testing Association for the Pulp and Paper Industry (TAPPI) Useful Method 557 as described herein (also known as the "3M" test).

Another feature of the invention is that the coated stock may be readily repulped. That is, the compositions of the invention are preferably water soluble, so that when the coated/printed stock is placed in water the coating and ink layers come off as a skimmable layer, leaving the stock ready for conventional repulping. Thus, previously hard to repulp products such as polyether wax treated poultry boxes can be easily repulped if the paper stock is first coated with compositions in accordance with the invention prior to application of wax and printing.

DETAILED DESCRIPTION OF THE PREFERRED EMBODIMENTS

Figure 1:
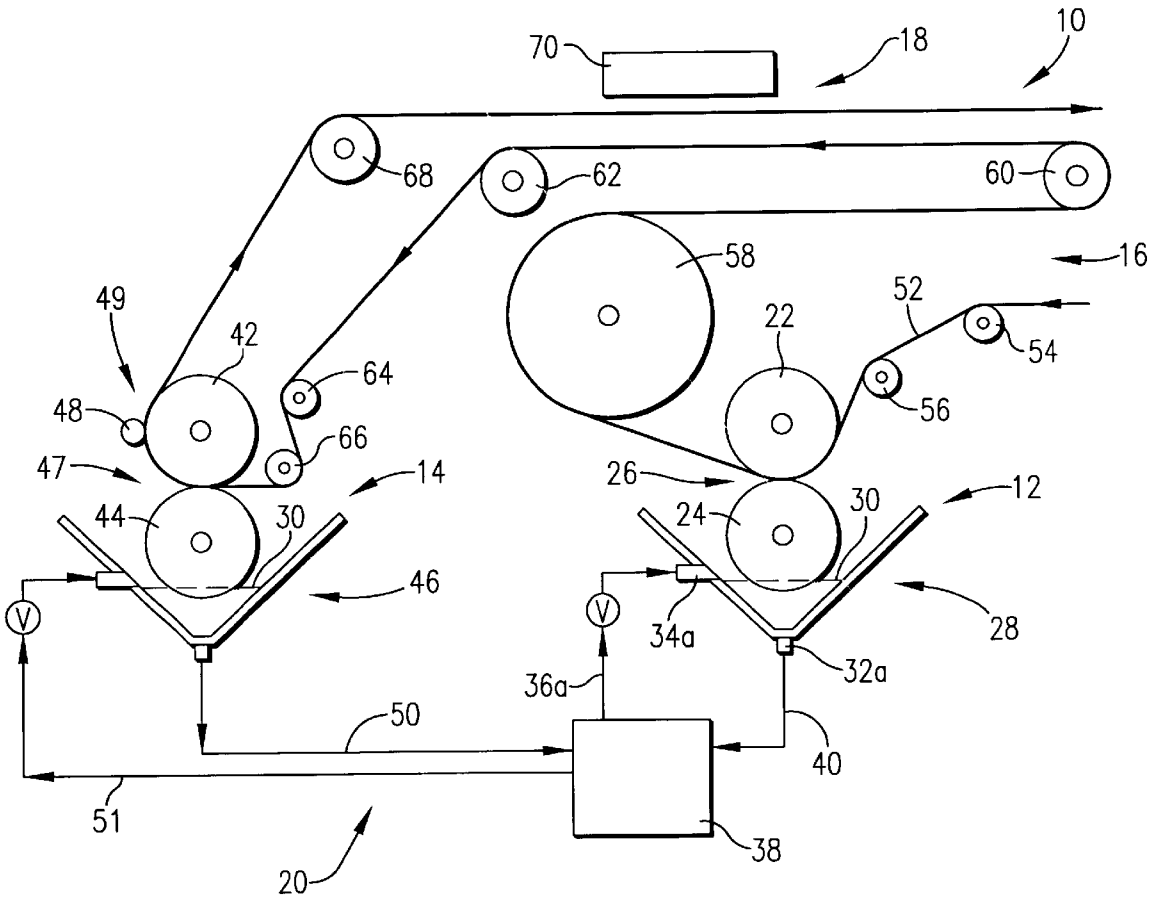
FIG. 1 is a schematic illustration of the preferred equipment for coating paper with the inventive coating composition.

Turning now to the drawing, a coating assembly 10 is depicted in FIG. 1. Assembly 10 includes first and second coating stations 12, 14, a web handling assembly 16 and drying station 18. The stations 12, 14 share a coating composition circulating assembly 20.

In more detail, the first coating station 12 includes an upper rubber coated cylinder 22 and an adjacent, lower engraved coating cylinder 24; as shown, the cylinders 22, 24 cooperatively present a coating nip 26. The overall station further includes an elongated, triangular in cross-section trough or pan 28 for holding a recirculating supply of coating composition 30. The cylinder 24 is situated within pan 28 below the normal level of composition 30 therein. The roll 24 is preferably provided with a helical surface groove (250 coils per inch of cylinder length and approximately 40 $\mu$m deep).

Figure 2:
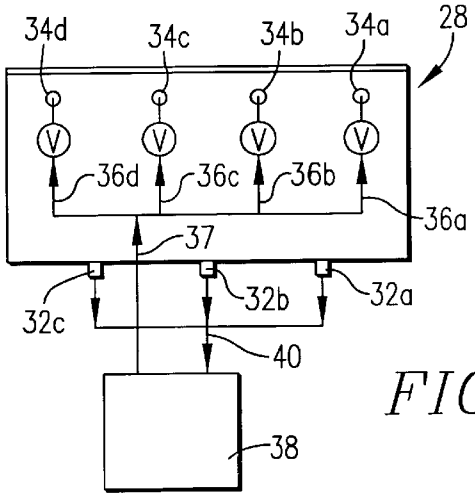
FIG. 2 is an end view of the coating storage and circulation systems depicted in FIG. 1.

As illustrated in FIG. 2, the pan 28 includes three spaced apart lower composition outlets 32*a*, 32*b*, 32*c* and four spaced apart upper inlets 34*a*, 34*b*, 34*c*, 34*d*. Valve-controlled inlet lines 36*a*, 36*b*, 36*c*, 36*d* are operatively connected to the respective inlets and to a supply 38 of the coating composition 30 via line 37. A return line 40 extends from the outlets 32*a*–32*c* to supply 38.

The coating station 14 is very similar to station 12, and includes rubber coated upper cylinder 42, engraved lower cylinder 44, and pan 46 adapted to hold the composition 30. The cylinders 42, 44 cooperatively define a coating nip 47 as shown. These components are identical with their counterparts in station 12, and thus need not be further described. However, the station 14 includes a 10 mm diameter smooth coating rod 48 adjacent upper rubber cylinder 42 and defining therewith another nip 49. It will also be seen that a return line 50 extends from supply 38 and is operatively coupled with the three lower outlets provided with pan 46, and that a supply line 51 extends from the supply 38 to the pan inlets. Thus, the circulation assembly 20 is made up of the supply 38 and the respective supply and return lines leading to the pans 28, 46. Although not shown, it will be appreciated that appropriate pump(s) are interposed within the supply lines for delivery of composition 30 to the individual pans.

The web handling assembly 16 is designed to guide and transfer a continuous web 52 into and through the coating stations 12, 14, and ultimately through drying station 18 for downstream processing. The assembly 16 includes, adjacent station 12, spaced apart guide rollers 54, 56 serving to guide the web 52 into and through nip 26. Downstream of the station 12, the assembly 16 includes a large heated roll 58 and spaced conveyor rollers 60, 62. At the region of station 14, the assembly 16 includes guide rolls 64, 66 serving to direct the web 52 through the coating nip 47. Finally, the assembly 16 includes one or more downstream conveyor rolls 68 serving to guide the web 52 through secondary nip 49 and drying station 18.

The drying station 18 includes one or more fans 70 as well as downstream dryer drums (not shown) preferably heated to a temperature of from about 240–300° F. Of course other types of drying apparatus can be used in lieu of that illustrated, so long as the composition 30 applied to the web 52 is sufficiently dried and cured.

Figure 3:
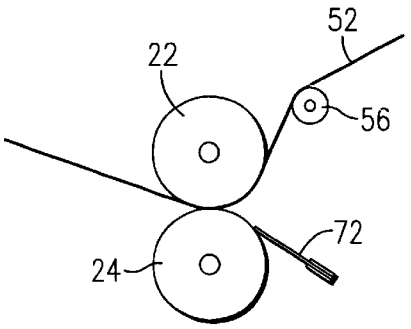
FIG. 3 is a schematic illustration of a modified coating apparatus making use of a doctor blade.

Referring to FIG. 3, a preferred alternate coating embodiment is illustrated, making use of a doctor blade 72 in contact with coating cylinder 24. In some instances, use of such a blade 72 provides improved coating performance. A doctor blade could be used in either or both of the coating stations 12, 14. Moreover, the blade 72 may be placed in a leading relationship as shown in FIG. 3, or in a trailing relationship where the blade is oppositely oriented against the cylinder 24.

In use, a web 52 of paper stock is trained through the assembly 10 as illustrated in FIG. 1. Thus, the web passes in serial order through the coating nips 26 and 47, and through secondary nip 49 during processing. As will be appreciated, the stations 12, 14 are operated during passage of the web 52 therethrough, with the cylinders 22, 24 and 42, 44 being continuously rotated. The helical grooves formed in the surfaces of the cylinders 24 and 44 "catch" portions of the coating composition 30 within the pans 28 and 46 and transfer such composition onto the surface of web 52. Between the stations 12 and 14, the composition 30 on the web 52 is at least partially cured and dried by passage around heated roller 58.

It will also be appreciated that the composition 30 is continuously circulated through the stations 12 and 14 by circulating assembly 20. It is preferred that the composition 30 is flowing or moving at all times. Moreover, the flow of composition 30 is adjusted so that the amount entering each pan 28, 46 through the inlets 34*a*–34*d* is slightly larger than the quantity of the composition which exists through the outlets 32*a*–32*c*. Thus, there is an excess amount of composition 30 entering each pan, as compared to the amount exiting the pan, with that excess amount being approximately equal to the amount of composition 30 which is applied to the web 52 in the respective coating stations. It has also been found preferable that the outlets 32*a*–32*c* and inlets 34*a*–34*d* be substantially uniformly spaced along the length of the coating cylinders 24 and 44, so as to provide a substantially even distribution of the composition 30 on the cylinders.

A first "bump" of coating composition 30 is applied to the web 52 in the station 12, and this "bump" is at least partially dried during passage around roller 58. A second "bump" of composition 30 is applied in station 14 with the latter being smoothed during passage through nip 49 by coating rod 48.

The fully coated and cured web 52 can be immediately printed using standard web-fed printing equipment and conventional inks. This can be done in-line, i.e., the coated web 52 is fed directly to the printing apparatus. Alternately, the web 52 can be rolled up for storage and later use.

EXAMPLES

The following examples set forth preferred methods in accordance with the invention. It is to be understood, however, that these examples are provided by way of illustration and nothing therein should be taken as a limitation upon the overall scope of the invention.

Example 1

Preparation of a Coating Composition

First, 740 parts by weight of $H_2O$ (ambient temperature and a pH of 8.3) and 0.1% by weight of a silicone defoamer (based upon the total weight of all ingredients used taken as 100% by weight; sold under the name PI-135 and obtained from INX International Ink Company) were placed in a Cowles dissolver having a peripheral speed of around 600 rpm. Mixing was commenced, and 100 parts by weight of FP3000 (a wheat gluten product containing approximately 90% protein and available from Midwest Grain Products, Inc., Atchison, Kans.) was gently and incrementally added to the mixer, verifying that all of the protein was wet with the water/defoamer solution. Mixing was carried out for about 5 minutes. The pH of the mixture at this point was about 5.

Next, 17 parts NaOH (10% solution) was slowly added to the mixture while mixing to give a pH of about 11.6 Mixing was continued for 5 minutes.

The mixture was quite thin at this stage. It was allowed to degas for about 30 minutes. Then, sodium metabisulfite (0.6% by weight, based upon the total weight of the FP3000 taken as 100% by weight) was added dry to the mixture under low rpm mixing for about 30 minutes. After mixing, 375 parts by weight of Midsol 50 (a wheat starch available from Midwest Grain Products) was added slowly over the course of about 7–8 minutes.

The final coating composition had a viscosity of 80 cP on a #2 spindle at 100 rpm and 73–74° F. The composition was bright tan in color, had a pH of 10.3, and a solids content of about 35% by weight.

Example 2

Properties of Coating

The composition prepared in Example 1 was applied to the finished side of 42 Kraft liner following the process illustrated in FIGS. 1 and 2 and described above. Coated samples were printed upon with black, red, blue, green and yellow ink according to conventional printing methods. The glosses of the samples were then determined using an Horiba IG-320 gloss checker with a 60° optical path. The gloss values ranged from 50 (for blacks) to as high as 60 and 65 (for reds and yellows, respectively).

Testing Association for the Pulp and Paper Industry (TAPPI) Useful Method 557, (also known as the 3M test) was used to determine the quality of the coating. In this test, solutions from various "kits" (see Table 1) were applied to the coating and allowed to remain thereon for as described in Useful Method 557. The penetration of the solution into the coating and paper was observed. If no penetration occurred for kits 1–5, then the coating is considered to have passed. Each of the samples coated with the inventive coating passed this test.

TABLE 1

| Kit # | Castor Oil (mL) | Toluene (mL) | Heptane (mL) |
|---|---|---|---|
| 1 | 200 | 0 | 0 |
| 2 | 180 | 10 | 10 |
| 3 | 160 | 20 | 20 |
| 4 | 140 | 30 | 30 |
| 5[a] | 120 | 40 | 40 |
| 6 | 100 | 50 | 50 |
| 7 | 80 | 60 | 60 |
| 8 | 60 | 70 | 70 |
| 9 | 20 | 80 | 80 |
| 10 | 20 | 90 | 90 |
| 11 | 0 | 100 | 100 |
| 12 | 0 | 90 | 110 |

[a]#5 kit to pass.

Example 3

One hundred parts of FP 3000 (a wheat gluten supplied by Midwest Grain Products, Inc. Atchison, Kans.), 375 parts Midsol 50 (a granular wheat starch supplied by Midwest Grain Products, Inc., Atchison, Kans.) and 0.5 parts sodium metabisulfite are mixed together in a batch mixer. The mixture is transferred to a Vacuum dispersion unit (VacuShear manufactured by Admix) equipped with a Rotosolver mixing head and additional mixing blades under 20 in" Hg vacuum. The VacuShear unit contains 700 parts water and 0.1% by weight of a silicone defoamer (based upon the total weight of all ingredients used taken as 100% by weight; sold under the name PI-135 and obtained from INX International Ink Company). The mixing speed is set at 1750 rpm. The transferring process takes about 3 minutes. The vacuum is allowed to increase to near full vacuum and about 17 parts of 10% NaOH solution is introduced quickly through a tube immersed under the dispersion media at a mixing speed of 2500 rpm. The dispersion goes through a gel phase and breaks loose to form a flowable dispersion. The whole process takes about 8–10 minutes. The temperature of the dispersion is around 76° F. The dispersion has a Brookfield viscosity of 180 cp (#2 spindle at 100 rpm) at a solids content of about 37% and a pH of 10.4. The dispersion is ready for use after release of the vacuum.

We claim:

1. The combination comprising:

paper stock presenting a surface; and a cured coating applied to said surface, said coating comprising an aqueous dispersion including from about 25–40% by weight filler and from about 6–18% by weight wheat gluten, based upon the total weight of the dispersion taken as 100% by weight, said dispersion having a Brookfield viscosity of less than about 2000 cP.

2. The combination of claim 1, including ink printing applied over said coating, said printing has a gloss value of from about 50–65 units.

3. The combination of claim 1, said printing giving a passing result when subjected to TAPPI Useful Method 557.

4. The combination of claim 3, wherein said paper is Kraft paper.

5. The combination comprising:

paper stock presenting a surface; and a dried coating applied to said surface, said coating comprising an aqueous dispersion including respective quantities of initially separate wheat starch and wheat gluten, said dispersion having a Brookfield viscosity of less than about 2000 cP, a pH of from about 9–12 and a solids content of from about 25–57% by weight, based upon the total weight of the dispersion taken as 100% by weight.

6. The combination of claim 5, including ink printing applied to said coating, said printing having a gloss value of from about 50–65 units.

7. The combination of claim 5, said printing giving a passing result when subjected to TAPPI Useful Method 557.

8. The combination of claim 5, wherein said paper is Kraft paper.

* * * * *